United States Patent [19]

Albrektsson et al.

[11] 4,176,814

[45] Dec. 4, 1979

[54] TERMINALLY CORRECTED PROJECTILE

[75] Inventors: Kjell A. Albrektsson; Bertil T. Eriksson; Sven W. Eriksson; Hans A. E. Franzén; Rolf H. Sandlin, all of Karlskoga, Sweden

[73] Assignee: AB Bofors, Bofors, Sweden

[21] Appl. No.: 776,683

[22] Filed: Mar. 11, 1977

[30] Foreign Application Priority Data

Apr. 2, 1976 [SE] Sweden ..... 7603926

[51] Int. Cl.[2] ..... F42B 15/10; F42B 13/30; F42B 15/02

[52] U.S. Cl. ..... 244/3.15; 244/3.21

[58] Field of Search ..... 244/3.15, 3.13

[56] References Cited

U.S. PATENT DOCUMENTS

| | | | |
|---|---|---|---|
| 3,485,461 | 12/1969 | Katsanis | 244/3.15 |
| 3,841,585 | 10/1974 | Evers-Euterneck | 244/3.15 |
| 3,844,506 | 10/1974 | Stavis et al. | 244/3.15 |
| 3,860,199 | 1/1975 | Dunne | 244/3.13 |
| 4,027,834 | 6/1977 | Heilig et al. | 244/3.15 |

*Primary Examiner*—Samuel W. Engle
*Assistant Examiner*—Thomas H. Webb
*Attorney, Agent, or Firm*—Pollock, Vande Sande & Priddy

[57] ABSTRACT

An apparatus for correcting the terminal portion of the ballistic trajectory of a projectile. The projectile is initially fired at a target in a manner to cause the projectile to rotate in flight. At least one detector is mounted on a front surface of the rotating projectile to rotate with the projectile and scan the target area in a spiral pattern. A laser beam is directed to hit the target and a reflected portion of the beam energizes the scanning detector. The energized detector transmits an ignition signal to activate a trajectory correction motor and an associated nozzle having a plug that is weakened in response to the signal. The activated motor operates during the terminal portion of the trajectory to generate a thrust pulse that is passed through the nozzle having the weakened plug. The thrust pulse is directed by the nozzle to correct the trajectory of the projectile.

11 Claims, 11 Drawing Figures

TERMINALLY CORRECTED PROJECTILE

Figure 1:
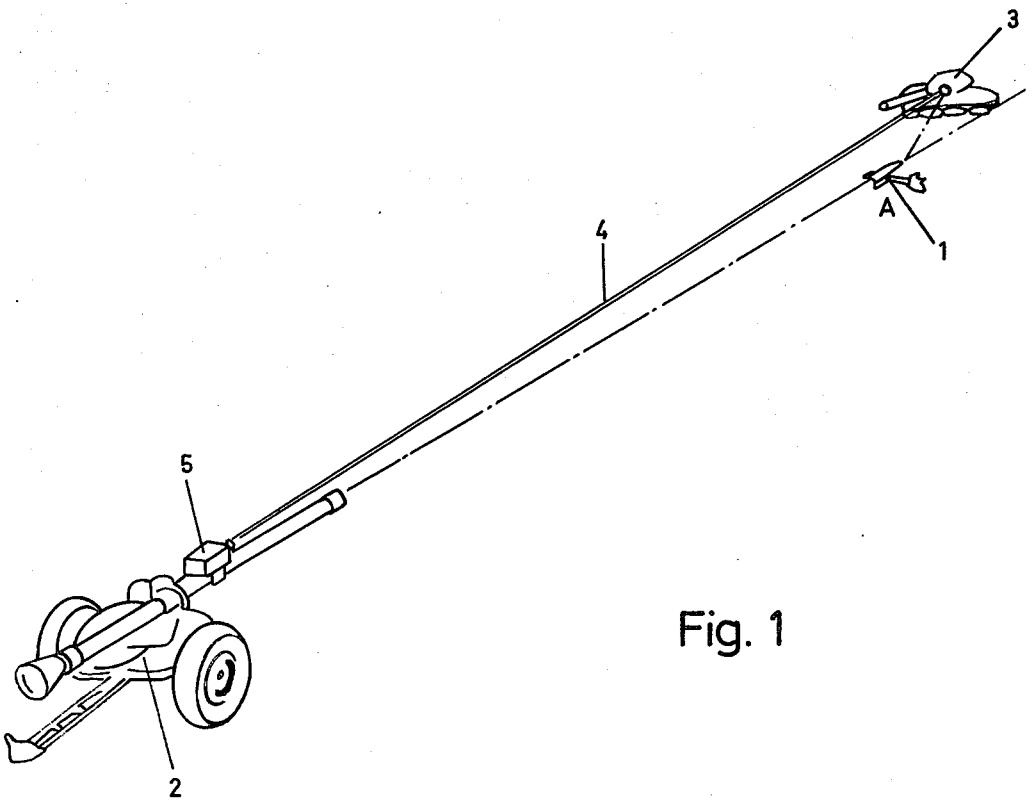

The present invention relates to a device for correcting a rotating projectile, for instance an anti-tank projectile, fired from a gun barrel, in the terminal phase of its ballistic trajectory, with the aid of a laser beam transmitted from a laser transmitter and directed towards the target, the projectile then comprising a target detector which in dependence on the echo signal received from the laser designated target transmits a signal, and a correction motor for correcting the trajectory of the projectile in dependence on said signal.

Notwithstanding improved methods for determining the positions of targets, conventional anti-tank guns have a limited, effective range. The unavoidable dispersion of the projectiles and the difficulties involved in determining the exact position of the target has the consequence that the probability of hitting rapidly decreases with the range. In order to put a target out of action, a large quantity of ammunition and considerable time is required, and in many cases this is not available in a duel situation.

In order to increase the probability of hitting and the range of conventional anti-tank guns, methods have been developed recently which are based upon so-called terminal phase correction of the projectiles. The projectiles are then fired in the conventional way in a ballistic trajectory towards the target. When the projectile comes into the vicinity of the target, a target detector initiates the correction of the trajectory required in order to hit the target.

In order to achieve terminal correction, a target detector is required, which transmits a signal if the projectile is on its way to a point beside the target, and also a device for correcting the trajectory of the projectile in accordance with the signal. The target detector can consist of, for instance, and IR detector which, with a scanning lobe, senses the area around the target and, if the target is detected, transmits one or several guidance pulses to the correction member so that the trajectory of the projectile is changed and is directed towards the target.

Compared with a missile, which is guided towards the target automatically or manually, the terminally corrected projectile will be less complicated to use, and cheaper, among other things due to the fact that conventional, already existing weapons can be used for firing of the projectiles. The projectile itself can also be made less complicated than a missile, as continuous guiding is not used.

In addition to the terminally corrected projectile having economic advantages compared with a missile, it is also more insensitive to jamming. A missile can be combatted with the aid of other weapons, and can be subjected to countermeasures of various kinds. A terminally corrected projectile, on the other hand, is more difficult to detect, and as it is guided only during the very last part of its trajectory, the possibilities of interfering with its guidance function are also reduced. The time of flight of the projectile will moreover be shorter than the time of flight of a missile.

However, due to the fact that the projectile rotates in its trajectory, the correction of its course is more difficult, as the roll position of the projectile must be determined when a guidance pulse is transmitted. It is previously known to determine the roll angle in relation to a reference direction with the aid of so-called rate gyros, followed by integration. However, the use of gyros involves a number of technical problems, such as drift in the gyro, bearing friction, sensitivity to acceleration, etc. Particularly because of its sensitivity to acceleration, the gyro is not suitable for use in a projectile which is fired from, e.g. a gun barrel. It is also previously known to determine the roll position of the projectile with the aid of polarized electromagnetic radiation, but for this purpose, special transmitter and receiver units are required, which make the equipment more complicated and expensive.

The purpose of our invention is to provide a terminally corrected projectile of the kind mentioned above that utilizes relatively simple target detection and trajectory correction means.

The invention is mainly characterized in that the target detector comprises one or several detectors, each detector having a field of view directed obliquely forwards, so that when the projectile approaches the target, the target scene is scanned in a spiral pattern from the outside and inwards towards the point to which the projectile is on its way and is connected with the correction motor in such a way that if the projectile is on the way to a point beside the laser designated target surface an ignition command is given to the correction motor by the detector that first detects the echo signal. In this way, the rotation of the projectile is utilized in the scanning procedure, and no special devices are required for sensing the absolute roll position of the projectile.

Further, the invention is characterized in that the correction motor comprises one or several nozzles which can be selected individually, each nozzle then being connected with a detector so that when an ignition command is given to the correction motor from one of the detectors a signal is also given at the same time to a nozzle plug applied in the corresponding nozzle.

In the following, preferred embodiments of the invention will be described in more detail, with reference to the accompanying drawings.

Figure 2:
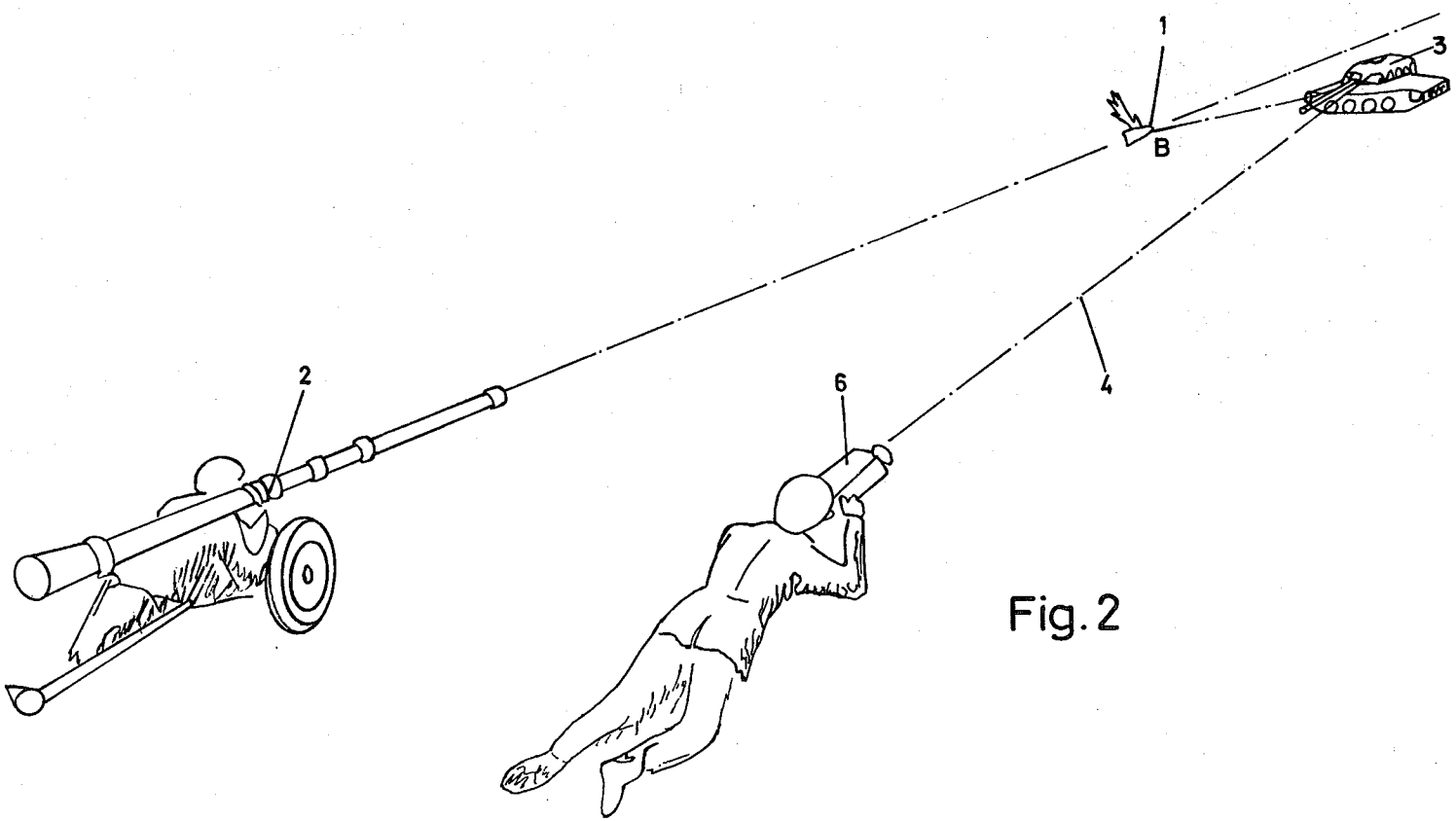
Figure 3:
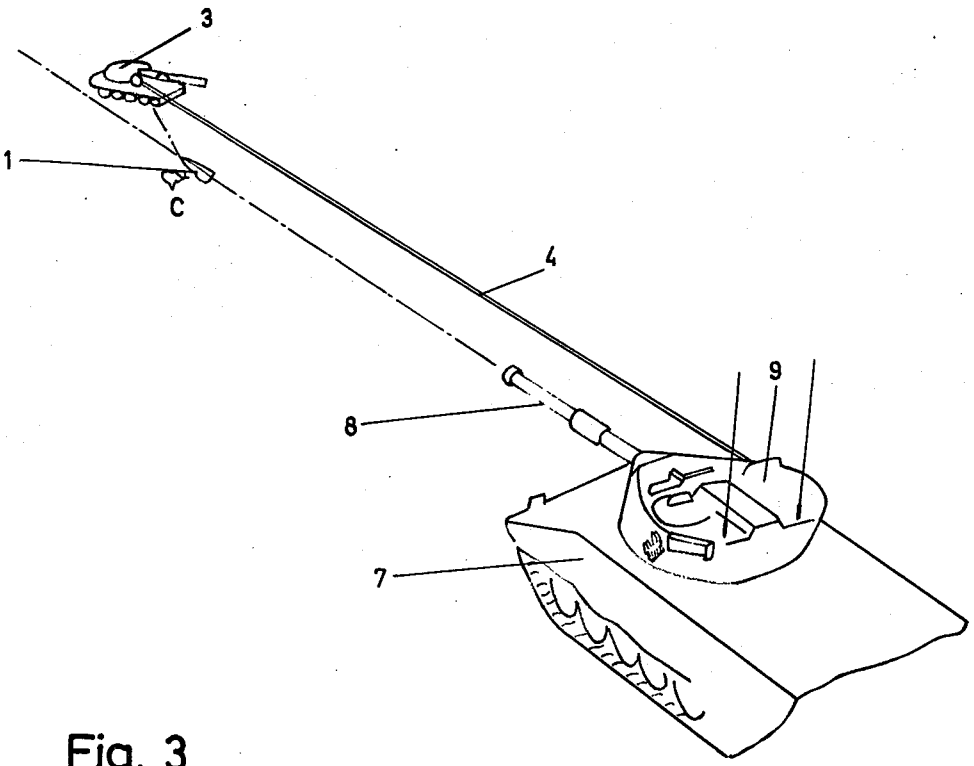
Figure 4:
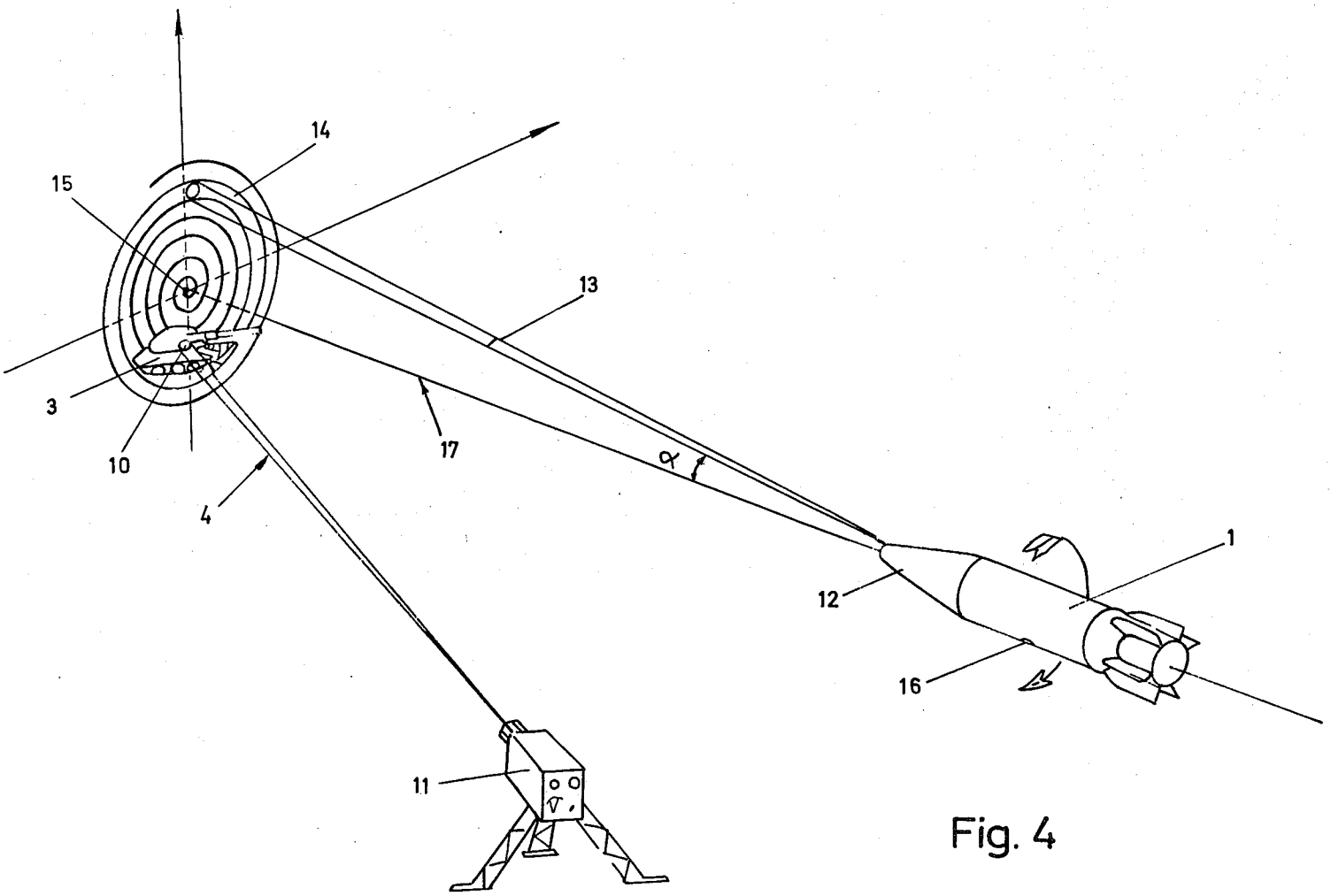
Figure 5:
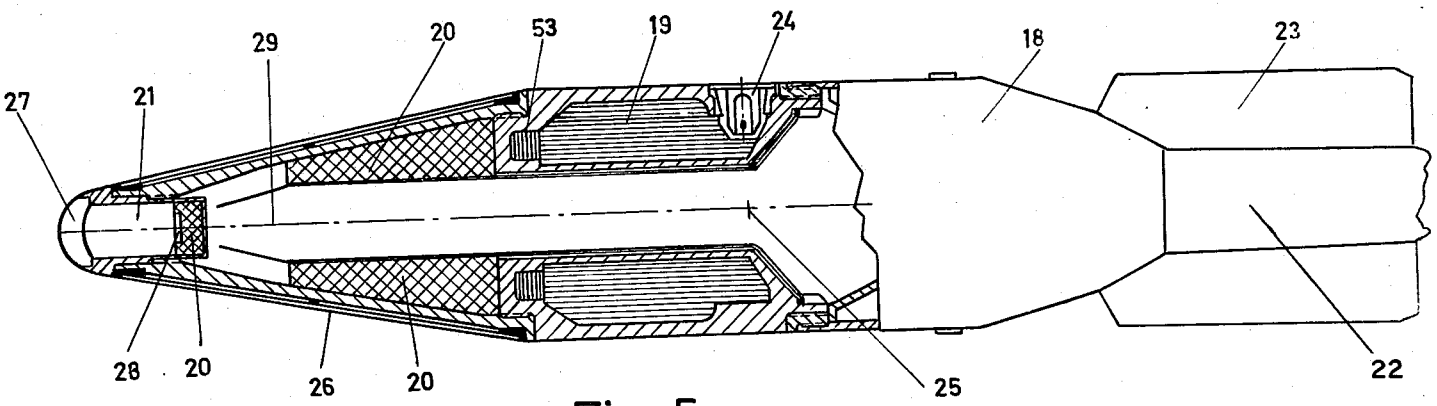
Figure 10:
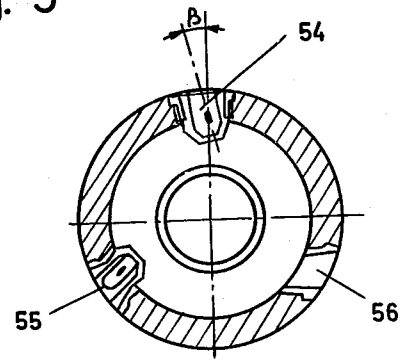
Figure 9:
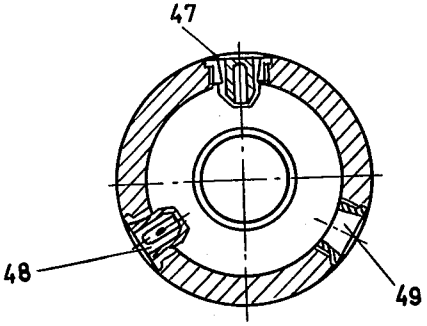
Figure 6:
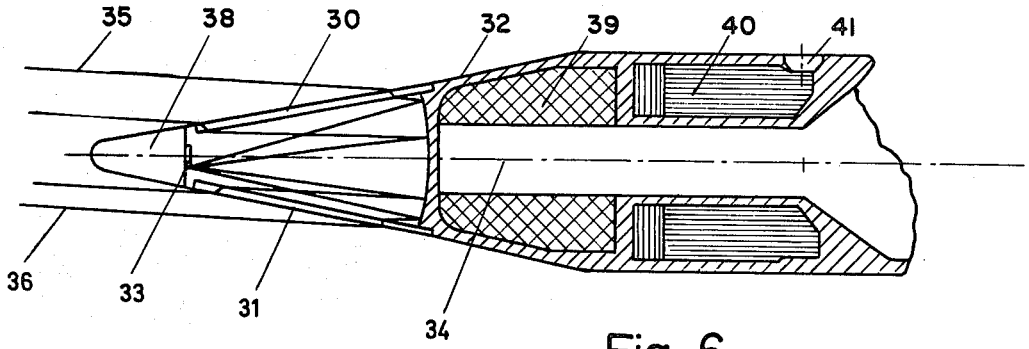
Figure 7:
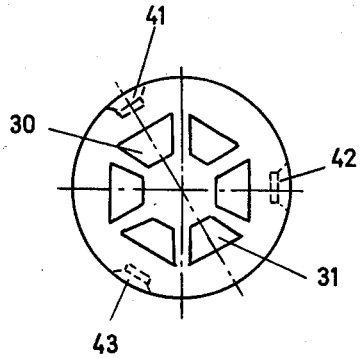
Figure 11:
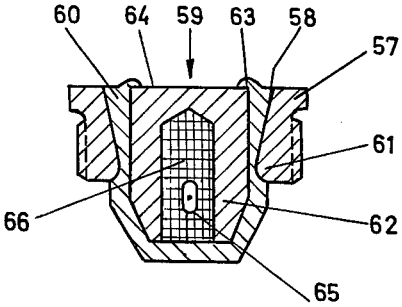
Figure 8:
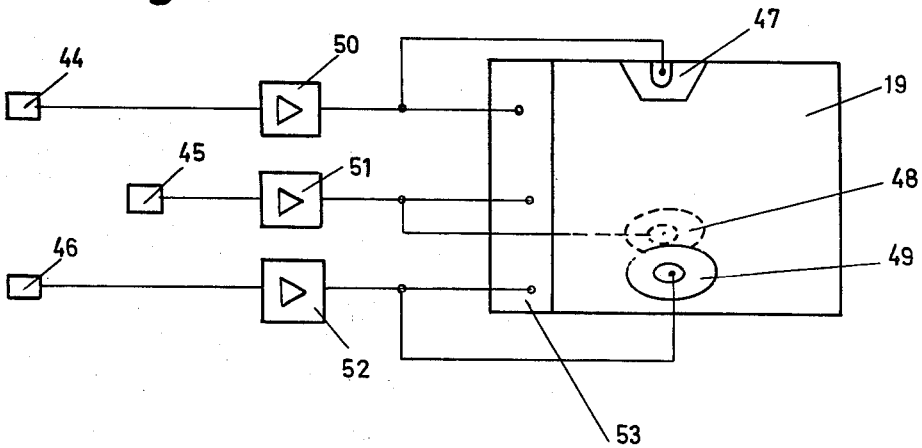

FIG. 1 shows a general view of the combatting of a target with a terminally corrected projectile from an anti-tank gun, FIG. 2 shows combatting of a target from an anti-tank gun, the laser designator then being separate from the weapon, FIG. 3 shows combatting of a target from a gun mounted on a tracked vehicle, FIG. 4 shows the principle of the function of the terminally corrected projectile, FIG. 5 shows the design, in principle, of the projectile, FIG. 6 shows an alternative embodiment of the target detector of the projectile, FIG. 7 shows a view from straight ahead of the target detector shown in FIG. 6, FIG. 8 shows a block diagram of the connection between the target detector and the correction motor, FIG. 9 shows the location of the nozzles of the correction motor through a cross-section horizontally in line with the centre of gravity of the projectile, FIG. 10 shows a similar cross-section in which the nozzles have been directed so that the rotation of the projectile is reduced, and FIG. 11 shows an example of an appropriate design of the nozzle plug.

As previously mentioned, the device proposed is characterized in that the terminally corrected projectiles can be fired from existing weapons without any modifications of these being required or any special preparations of the weapons having to be made. The general views shown in FIGS. 1–3 of combatting of targets with the aid of a terminally corrected projectile thus show conventional anti-tank weapons, in the form of a field gun and in the form of a gun mounted on a tracked vehicle. Even if the description, in the following, primarily refers to these two weapon systems, this is not to be understood as any limitation of the use.

FIG. 1 shows an armour-piercing projectile 1 which in a conventional way has been fired from an anti-tank gun 2 and is in a ballistic trajectory on its way towards a target 3. In the figure, the target consists of an armoured vehicle, but it should be obvious that the invention can be applied also to targets of other types, for instance naval targets. In order to increase the probability of hitting of the projectile, the course of the projectile is corrected during the final phase of the trajectory with the aid of a laser beam 4 reflected in the target, which is transmitted from a laser transmitter 5 and is kept directed towards a part of the target 3. The projectile is equipped with a target detector which scans the target scene and transmits a signal if the projectile is on the way to a point beside the laser-illuminated target surface.

In order that the laser beam 4 may be directed towards the target, the laser transmitter 5 is combined with an optical sight, the line of sight of which is kept directed towards the target by the laser operator. The laser transmitter 5 is also integrated with the firearm 2, and appropriately also comprises a receiver for range finding, which often is a necessary function also for a conventional anti-tank gun system. The laser operator is then responsible for keeping the laser transmitter 5 directed towards the target, both before firing, for range finding, and after firing for illumination of the target during the latter part of the trajectory of the projectile. The laser transmitter 5 is of a kind previously known, and will therefore not be described in detail.

Particularly when firing against moving targets, in which case the direction of the line of sight must be changed all the time, it may happen that the laser operator (the gunner) aims beside the target, due to disturbances in connection with the firing of the projectile. Such disturbances occur in the weapon in the form of movements in connection with the recoil impulse, and also in the form of a muzzle flash and smoke. The sight should therefore be gyro-stabilized, or located at a distance from the weapon, so that it is not influenced by these disturbing factors. FIG. 2 shows an example of combatting of a target with a terminally corrected projectile where the laser transmitter 6 is separate from the weapon 2 and is located at a distance from this, and is served by a special operator. In this situation, it may be necessary that the gunner's sight is provided with a device for detecting the laser reflection from the target 3 so that the gunner may be sure that he has selected the same target as the laser operator.

FIG. 3 shows an example of how the system can be adapted to a vehicle 7 on which a weapon is mounted. The terminally corrected projectile 1 is fired in a conventional way from the main gun 8 of the vehicle, but at point C it obtains a correction, as the projectile is on the way to a point beside the laser-illuminated surface of the target. The laser transmitter 9 is built into the turret of the vehicle, and can appropriately be combined with a laser range finder in the vehicle.

FIG. 4 shows the principle of the function of the terminally corrected projectile. The target 3, in the form of a tank, is illuminated with a laser beam in the form of a narrow lobe 4, and the illuminated target surface 10 can then have a diameter of, say, 0.5 m. The laser designator 11 can possibly be provided with step-zoom optics, for adaptation of the laser lobe 4 to different target ranges.

In the front part of the projectile 1 there is a target detector 12 which, for scanning of the target scene, utilizes the rotation of the projectile. The target detector has a narrow field of view 13, directed obliquely forwards, and when the projectile approaches the target, the target scene is scanned in a spiral pattern 14, from the outside and in towards the point 15 to which the projectile is on its way. If the projectile is on the way to a point beside the laser-illuminated target surface 10, this is detected by the target detector, which gives an ignition command to the correction motors 16 of the projectile. The impulse from the correction motor is applied on a level with the centre of gravity of the projectile and gives the projectile added velocity substantially at right angles to the trajectory 17 of the projectile, to move the projectile towards the target and to thereby correct the trajectory of the projectile.

It is a requirement that the laser designator 11 can illuminate a small part of the target, and that the pulse frequency is so high that during the rotation of the projectile it will be certain that the target detector will detect a laser pulse at a few degrees roll turning.

The design, in principle, of a terminally corrected projectile is shown in FIG. 5. The main parts of the projectile are a payload 18, a correction motor 19, electronics part 20, and in the front end of the projectile a target detector 21. The payload 18 of the projectile, including its ignition system in the form of a fuze 22, consists of known parts, and therefore will not be described in detail. The rear part of the projectile is moreover provided with an appropriate fin arrangement 23. In order to maintain the rotation of the projectile in the trajectory, so that the rotating speed will be well determined, the fins have been set obliquely. Alternatively, the leading edges of the fins can be chamfered.

The correction motor 19 is located in front of the payload, and consists of a ring-shaped powder rocket motor which is characterized by rapid ignition and a short burning time. The powder motor is provided with one or several nozzles 24 which can be selected individually, arranged around the periphery of the projectile and on a level with its center of gravity 25, in order that there shall be small oscillations at the correction.

The electronics part 20, including the battery, is installed in front of the correction motor 19. The electronics part is contained in the nose of the projectile, the fairing of which consists of a full-calibre contact device 26 for the fuze 22.

The spirally scanning target detector is arranged at the front end of the projectile, and consists of image-forming optics in the form of a lens 27 in the nose of the projectile and one or several detectors arranged in a detector plane 28. The field of view of the detectors is directed obliquely forwards, with a fixed viewing angle $\alpha$ (see FIG. 4) in relation to the axis of the projectile. This fixed viewing angle is achieved by the detectors being located excentrically in relation to the axis 29 of the projectile. Each detector is connected to one of the nozzle plugs 24 of the motor, i.e. each detector has a special nozzle plug. When the detector "sees" the laser-illuminated part of the target, the target detector has determined the angle of view to the target and the direction in roll position. The detector that first sees the laser spot 10 immediately initiates the correction motor 19 and opens "its" nozzle. Because of the ignition delay, and with consideration to the burning time of the correction motor, an aim-off in the roll direction of the field of view of the target in relation to the nozzle is required. The angle of aim-off is calculated with consideration to the roll angle speed and the ignition delay. These factors vary between rounds and during the firing of a round with the temperatures and other firing conditions. The variations in impulse direction which then arise can be accepted in certain applications at the expense of a shorter range. It should be obvious, however, that the dependence of the process on magnitudes that can be foreseen (e.g. the velocity of the projectile) or measured (e.g. temperatures) can be compensated, for instance through electronic means in the projectile.

In FIG. 5, the optics of the spirally scanning target detector are located at the front end of the nose of the projectile. FIG. 6 shows an alternative embodiment of the target detector, where the optics consist of a number of obliquely set windows 30, 31 located in the conical envelope surface 32 of the nose section and a concave mirror 37 in which the echo signal entering through the windows is reflected. The detectors of the target detector are arranged in a plane 33 and are located excentrically in relation to the axis 34 of the projectile, in order that a number of fields of view 35, 36 directed obliquely forwards, shall be obtained. In this case, the contact device for the fuze of the projectile is located in the front end of the nose 38. For the rest, the projectile is built up in the same way as the one shown in FIG. 5, and comprises an electronics part 39 and a correction motor 40 with a number of nozzles 38 which can be selected individually, each nozzle plug then being connected with a detector.

FIG. 7 shows a view of the projectile from straight ahead, from which it will be noted that the aperture, as an example, comprises 6 windows 30, 31. The figure also shows the location of three nozzles 41, 42 and 43, which have been indicated with dash lines.

FIG. 8 shows a block diagram of the connection between the detectors of the target detector and the nozzles of the powder rocket motor. The detector elements 44, 45, 46 can be equally spaced along a circular line in the detector plane, the centre of which coincides with the axis of symmetry of the projectile. As previously mentioned, through the excentric location, each detector obtains a field of view which is directed obliquely forwards. Each detector is connected to one of the nozzles 47, 48 and 49 of the motor. The detector which first "sees" the laser spot transmits a signal via an amplifying circuit 50, 51 and 52, to the nozzle plug in question and also to the ignition device 53 of the motor. Through this signal, the main charge of the powder motor is ignited at the same time as the nozzle in question is opened. The other nozzles remain closed, as no signal is transmitted to their nozzle plugs. The way in which the nozzle is opened will be described in more detail with reference to FIG. 11. The powder gases from the motor will flow out through the opened nozzle, and give the projectile added velocity substantially at right angles to its direction of movement.

FIG. 9 shows a cross-section, in line horizontally with the centre of gravity of the projectile, from which it will be noted that the three nozzles 47, 48 and 49 are arranged symmetrically around the periphery of the projectile. Two of the nozzles are intact, while the third nozzle (47) has been actuated so that an open passage has been formed for the powder gases from the motor.

FIG. 10 shows a similar cross-section of three nozzles 54, 55 and 56. Here the direction of the nozzles form an angle $\beta$ with the radius so that the projectile is given an impulse moment around the axis of roll of the projectile when one of the nozzles is actuated. The direction of the nozzles is then chosen in such a way that the impulse moment has a direction opposite the direction of rotation of the projectile. This is an advantage from the point of view of effect, as the impulse moment can then be chosen so that the rotating speed of the projectile, after the correction pulse, will be practically zero. When the payload consists of a hollow-charge warhead, the capability of piercing armour increases, particularly at long stand-off distances.

The design of the nozzle plug is shown in detail in FIG. 11, which shows a cross-section through one of the nozzles of the correction motor. The nozzle itself consists of a sleeve-shaped part 57, screwed into the wall of the projectile, and the internal surface 58 is tapered, in order to form an opening 59 in the wall of the projectile which is narrowed inwards. Normally, this opening is sealed by means of a nozzle plug 60 which is firmly pressed into the nozzle, and closely fits its tapered inner surface 58. In order to more easily be able to withstand the working pressure of the powder motor, the outer envelope surface of the nozzle plug is provided with an indented part, which fits into the narrowest section 61 of the nozzle.

The nozzle plug itself consists of two parts, as it comprises a solid cylindrical piston 62, which is held in place in the plug by this being made with a lip-formed section 63 which is in contact with the outer end surface 64 of the piston. Inside the piston there is an igniter 65, which is connected to one of the detectors of the target detector. When an ignition current flows through the igniter, an initiating charge 66 is ignited, which involves that the piston is pushed out of the nozzle plug, which reduces the strength of the plug.

When the main charge of the powder motor begins to be ignited, the pressure becomes too high for the weakened nozzle plug, which is therefore ejected, and the powder gases can flow out through the opening. The other nozzle plugs, which have not obtained any ignition current from the detectors of the target detector, are not weakened, and therefore withstand the working pressure of the powder motor.

The invention is not limited to the embodiment shown above as an example, but can be subject to modifications within the scope of the accompanying claims.

For instance, it is not necessary that the detector transmits a separate signal to the ignition device of the powder motor. Also the signal transmitted to the nozzle plug can be utilized for ignition of the powder motor.

We claim:

1. An apparatus for correcting the terminal portion of the ballistic trajectory of a rotating projectile to direct the projectile to a target, comprising:

targeting means for directing a beam of coherent light at said target;

at least one target detector means disposed for rotation with said rotating projectile and facing obliquely forward in the direction of travel of said projectile to scan in a spiral pattern the area adjacent the projected point of impact of the projectile, said at least one target detector having means for generating a particular ignition signal when the coherent light reflected from said target is detected;

motor means for generating a thrust pulse in response to an ignition signal;

at least one nozzle means connected to said motor means and having plug means responsive to said particular ignition signal to pass said thrust pulse, said at least one nozzle means directing the passed thrust pulse in a direction to correct the trajectory of said projectile.

2. An apparatus according to claim 1 wherein said motor means is a powder rocket motor.

3. An apparatus according to claim 1 wherein said at least one nozzle means is arranged in the envelope surface of the projectile, on a level with the centre of gravity of the projectile and is directed outwards radially, so that when the motor means is actuated, the projectile obtains added velocity, substantially at right angles to the axis of the projectile.

4. An apparatus according to claim 3 wherein said at least one nozzle is positioned at an angle with respect to a radial line from the longitudinal axis of the projectile to provide an impulse moment around said longitudinal axis when said at least one nozzle is operated to pass said thrust pulse.

5. An apparatus according to claim 4 wherein said at least one nozzle is positioned in a direction to provide said impulse moment in a direction opposite the direction of rotation of the projectile to reduce the rotating speed of the projectile.

6. An apparatus according to claim 3 wherein said at least one nozzle includes a sleeve-shaped portion screwed into the wall of the projectile and having a tapered inner surface for forming an opening which is narrowed inwards in the wall of the projectile, the opening normally being sealed by the plug means.

7. An apparatus according to claim 6 wherein said plug means includes means for withstanding the working pressure of the motor means and ignition charge means for weakening said plug means in response to said particular ignition signal to pass said thrust pulse.

8. An apparatus according to claim 7 wherein said means for withstanding working pressure includes a solid piston and said ignition charge means includes an explosive charge and associated igniter disposed in said solid piston, said igniter setting off said explosive charge in response to said particular ignition signal to push said solid piston from said plug means, thereby weakening said plug means.

9. An apparatus according to claim 1 including a plurality of target detector means arranged in a detector plane in the front part of the projectile and positioned in a circular array about the axis of the projectile.

10. An apparatus according to claim 9 wherein the target detector means includes a lens located at the front end of the nose of the projectile.

11. An apparatus according to claim 9 wherein the target detector means includes a plurality of windows arranged obliquely in the surface of the conical envelope of the nose section of the projectile.

* * * * *